US005325760A

United States Patent [19]

Dennis, deceased

[11] Patent Number: 5,325,760

[45] Date of Patent: Jul. 5, 1994

[54] AUTOFIRE MECHANISM FOR INDUSTRIAL GUNS

[75] Inventor: William G. Dennis, deceased, late of Florissant, Mo., by Barbara M. Dennis, executrix

[73] Assignee: Olin Corporation, East Alton, Ill.

[21] Appl. No.: 999,346

[22] Filed: Dec. 3, 1992

[51] Int. Cl.[5] ..... F41A 3/06

[52] U.S. Cl. ..... 89/25; 89/27.11

[58] Field of Search ..... 42/26, 28, 29; 89/25, 89/27.11, 27.3, 149

[56] References Cited

U.S. PATENT DOCUMENTS

| | | | |
|---|---|---|---|
| 445,880 | 2/1891 | Warnant-Creon | 42/29 |
| 493,987 | 3/1893 | Driggs | 89/27.11 |
| 1,341,117 | 5/1920 | Fischer | 42/106 |
| 2,021,126 | 2/1878 | Sneider | 42/28 |
| 2,606,384 | 9/1950 | Perry | 42/28 |
| 2,607,148 | 8/1952 | Simpson | 42/69.01 |
| 3,091,878 | 6/1963 | Sdvioli | 42/69.01 |
| 3,141,254 | 7/1964 | Savioli | 42/70.06 |
| 3,168,788 | 2/1965 | Coulter | 42/69.01 |
| 3,507,184 | 4/1970 | Prybyla | 89/33.05 |
| 4,341,031 | 7/1982 | Palmer et al. | 42/23 |
| 4,444,088 | 4/1984 | Olson | 42/25 |
| 4,869,008 | 9/1989 | Rasmussen | 42/71.01 |
| 4,986,019 | 1/1991 | Dennis, Jr. | 42/69.01 |

FOREIGN PATENT DOCUMENTS

| | | | |
|---|---|---|---|
| 684146 | 11/1936 | Fed. Rep. of Germany | 89/25 |

*Primary Examiner*—Stephen C. Bentley

*Attorney, Agent, or Firm*—Gregory S. Rosenblatt; Bruce E. Burdick

[57] ABSTRACT

An industrial gun which has an autofire mechanism which automatically pulls its own trigger in response to continued movement of a breech closing handle in the closing direction and the method of use of such a gun.

3 Claims, 3 Drawing Sheets

AUTOFIRE MECHANISM FOR INDUSTRIAL GUNS

BACKGROUND OF THE INVENTION

1. Field of Invention

This invention relates generally to industrial guns. More particularly, the invention relates to manual firing mechanisms for industrial guns of the type having a rotary handle operated pivoting combination loading ramp and breech block.

2. Description of the Related Art

Industrial 8 gauge shotguns have been used for many years to shoot 8 gauge shotgun slugs into rotary kilns to knock off slag rings which form on the interior of the kilns. Such kilns are large and hot and the use of such guns avoids the previous practice of allowing the kiln to cool and having men enter the kiln and beat the rings off with hammers and picks. With the industrial 8 gauge kiln gun, the kiln need not be cooled and no men have to enter the kiln. The Industrial 8 gauge kiln gun pays for itself by greatly reducing down time. One leading 8 gauge kiln gun is the WINCHESTER RINGBLASTER brand gun made and sold by the Winchester Division of Olin Corporation, East Alton, Ill. The current version of that gun is the one described in U.S. Pat. No. 4,444,088 to Olson dated April 1984, and an alternative version proposed to use a pistol type hand grip is shown in U.S. Pat. No. 4,986,019 to Dennis dated Jan. 22, 1991.

The WINCHESTER RINGBLASTER brand gun is the world's best selling 8 gauge kiln gun and is an excellent and reliable product. This invention seeks to improve the firing mechanism of that type of gun to allow it to be loaded with one hand and fired with the other to speed up the firing rate yet retain safety and control. The faster rate further reduces kiln down time.

A new technical approach is needed which can allow such one handed operation.

SUMMARY OF THE INVENTION

These problems are solved in the process of the present invention described and claimed below in which a gun is automatically fired when the breech block is fully closed. This is done by connecting the breech block handle by a flexible pulling means to the gun's trigger in such a way that the pulling means pulls the trigger when the breech block handle is fully rotated toward a closed breech position.

The invention stems from a thorough understanding of the manner in which the gun is used in practice and a thorough understanding of the method of operation of the gun coupled with a practical and creative approach to making that operation and use simpler and more reliable. In the age of high-tech it is refreshing to see a simple change that results in a major improvement which has not been realized in more than a decade of operation.

BRIEF DESCRIPTION OF THE DRAWINGS

The invention will be better understood by reference to the enclosed drawing in which.

DETAILED DESCRIPTION OF THE INVENTION

BASIC DESCRIPTION

The current best-selling industrial 8 gauge kiln gun is that shown and described in U.S. Pat. No. 4,444,088 to Olson dated April 1984. This invention simplifies the process of firing the gun automatically by connecting the trigger directly to the cocking cam through a flexible puller such as a small roller chain and links with a adjusting bolt. Rotation of the cocking cam closes the breech block in conventional manner, but at the very end of the cam's rotation, now also pulls the puller which in turn pulls the trigger. The invention improves customer satisfaction by minimizing down time of the kiln and by greater reliability of the gun through simplification and elimination of parts.

PREFERRED EMBODIMENTS

Figure 1:
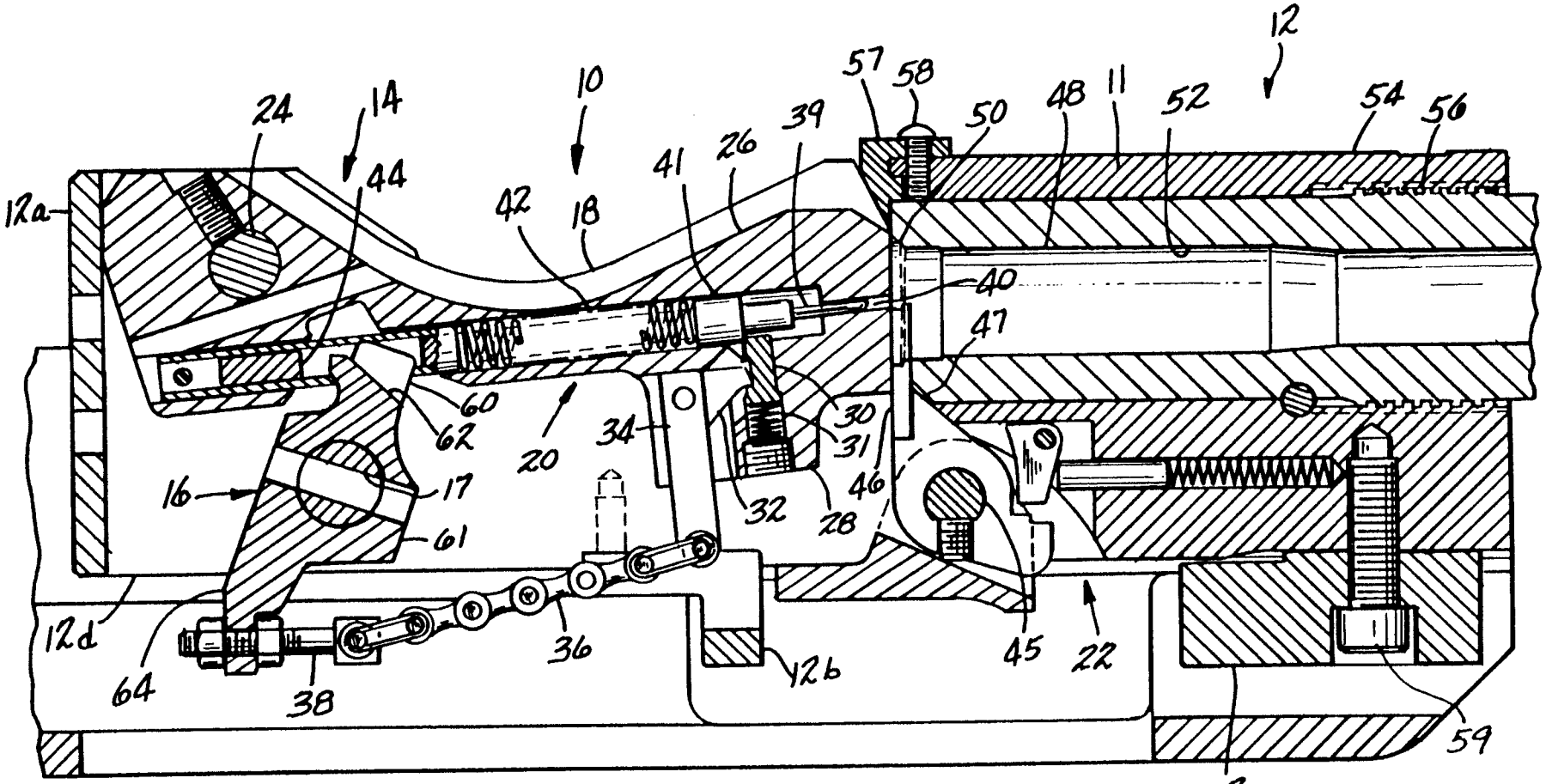
FIG. 1 is a vertical sectional view of a kiln gun taken along the axis of the gun barrel showing the autofire mechanism of the invention in the breech closed position just before firing.

Referring first to FIG. 1, the preferred kiln gun 10 comprises a receiver 12, a barrel 11 and a breech block assembly 14. A breech block assembly comprises a cocking cam 16, a breech block 18, a firing mechanism 20 and an extraction mechanism 22.

Breech block 18 is rotably mounted on a pivot pin 24 of receiver 12. Breech block 18 comprises a loading ramp 26, a foot portion 28 and a bore 29. Firing mechanism 20 comprises a sear 30, a sear spring 31, a sear puller 32, a trigger 34, a chain 36, a chain adjusting bolt 38, a firing pin 39 with a tip 40 and a body 41, and a firing pin spring 42. Body 41 of firing pin 39 has a cam slot 44.

Extraction mechanism 22 is mounted on a pin 45 of receiver 12 and includes an arcuate extractor 46 and an extractor cam 47.

Barrel 11 is intended to hold a shotshell 48 (adapted to be used with the invention, but not a part of the invention) of any suitable gauge with a rim 50, such as an 8 gauge shotshell loaded with an industrial slug of conventional type. Barrel 11 is provided with a barrel chamber 11 for this purpose. Barrel 11 is mounted in a barrel holder 54 by threads 56 or other suitable means. A locking lip 57 is mounted on the rear of the barrel holder 54 by a screw 58 or other suitable means in order to limit the upward movement of block 18 at a position lining the firing pin up with the center of the base of a shotshell 48 in chamber 52. Barrel holder is held in receiver 12 by a fastener 59.

Receiver 12 has a backframe portion 12*a*, a pivot pin 24, a footrest portion 12*b*, a barrel holder mounting portion 12*c*, and two sideplates 12*d*. Pivot pin 24 and extractor mounting pin 45 are each held in holes (not shown) of the sideplates 12*d*. Fastener 59 is fastened to portion 12*c* and foot rest 12*b* is positioned to restrain the downward movement of foot 28 of block 18.

Cocking cam 16 comprises a pin 17, a raising arm 60, a main body 61, a lowering arm 62 and a firing arm 64. Body 61 is mounted rotably on pin 17 and pin 17 is mounted in holes (not shown) in sideplates 12*d*. One or more raising arms 60 extend upwardly from body 61. Lowering arm 62 extends upwardly and rearwardly from body 61 and firing arm 64 extends downwardly from body 61.

PREFERRED MODE OF OPERATION

In operation, the parts have the position shown in FIG. 1 when the gun is cocked just prior to firing.

Figure 2:
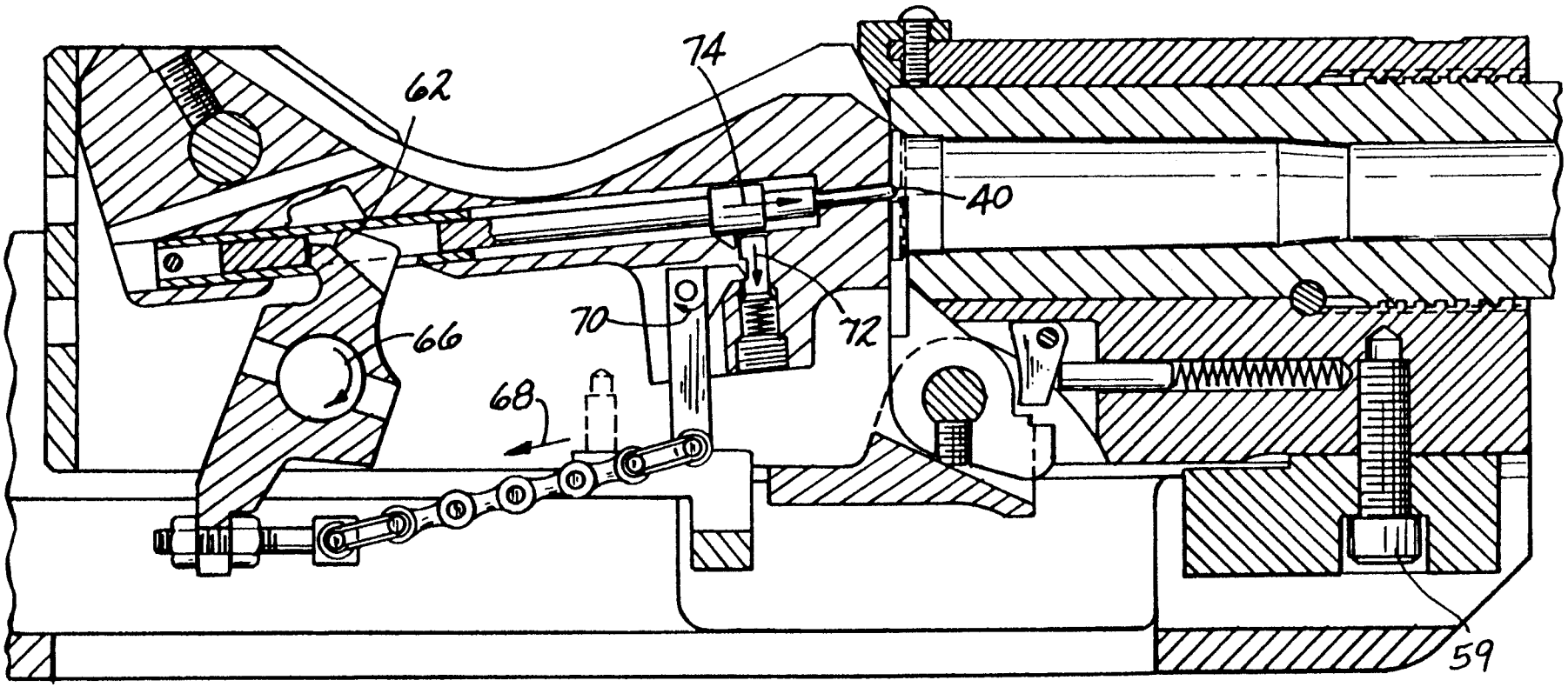
FIG. 2 is a vertical section identical to FIG. 1 except showing the gun at the moment of firing.

To fire the gun from the position in FIG. 1, the sequence of actions shown in FIG. 2 are instituted by rotating cocking cam 16 clockwise as shown by arrow 66. A handle (not shown) is conventionally provided on cocking cam 16 for purposes of rotation. The clockwise rotation of cam 16 tightens chain 36 and moves chain 36 rearwardly in the direction of arrow 68. Chain 36 in turn pulls rearwardly on the lower end of trigger 34 to rotate it clockwise in the direction of arrow 70. Sear puller 32 is rigidly connected to trigger 34 so that puller 32 is rotated downwardly and pulls sear 30 downward to release the body 41 of firing pin 39. Firing pin 41 moves rapidly forward under the force of firing spring 42 and tip 40 slams into the center of shotshell 48 causing it to fire.

Figure 3:
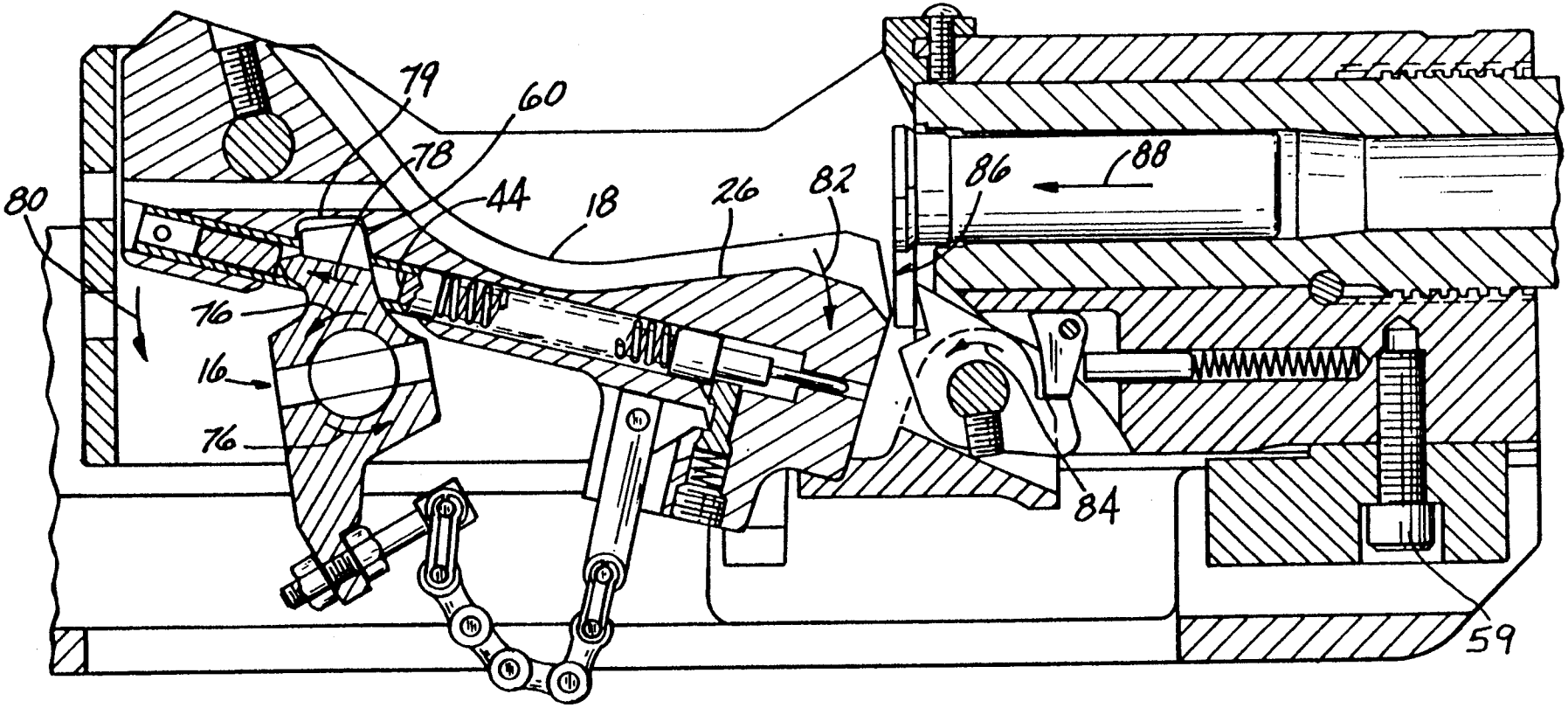
FIG. 3 is a vertical section identical to FIGS. 1 and 2 but showing the autofire mechanism in the breech open position for loading.

Once the shotshell has fired, the shell has to be removed and the gun readied for loading of the next shell. This sequence of events is shown in FIG. 3. The cocking cam 16 is rotated counterclockwise as shown by arrows 76 causing lowering arm 62 to move rearwardly in cam slot 44 against the firing pin body. This causes the firing pin to move rearwardly allowing sear 30 to reengage body 41. The rearward movement also allows raising arm 60 to align with and enter a recess in the breech block, allowing the block 18 to fall clockwise in the direction of arrow 80 to pull loading ramp 26 downwardly in the direction of arrow 82 to a point sufficient to fully expose the rim 50 of shotshell 48. This frees extractor cam 47 to rotate counter clockwise and force extractor 46 rearwardly as shown by arrow 86 pulling shotshell 48 by its rim 50 backwardly at least partially out of chamber 52. The shotshell can now be pulled completely out of chamber 52 and discarded. The gun is now ready to be loaded again.

A new shell is then placed onto loading ramp 26 and shoved into chamber 52. Then the cocking arm is rotated back clockwise to the position in FIG. 1 to prepare for the next shot, causing raising arm 60 to push against the front wall of recess 79 to force block 18 upwardly to close the breech of the gun. It will be noted that the raising arm must move out of recess 79 before contacting the forward end of cam slot to compress the firing spring 42. Further movement of the cocking arm clockwise causes the firing spring to compress and the trigger to be pulled, which in turn causes the gun to fire again. The cocking cam is then rotated counterclockwise to allow the breech block to fall and the shell be extracted. The process is repeated until the kiln is cleaned.

It will be noted that all the operator of the gun has to do is move the cocking lever and remove and insert shells. A reasonably ambidextrous person can remove and load shells with one hand while moving the cocking cam handle with the other hand. The operator need not release the handle at all, thus greatly simplifying operation and allowing much greater speed and reliability. With prior guns, it was generally necessary to use two operators to obtain full speed since there were three handling operations involved: (1) handle movement, (2) shell handling and (3) trigger pulling. This invention combines the first and third handling operations so that a two handed person only has to perform two operations.

The position of FIG. 3 is a safe position with the firing pin out of alignment so that storage of the gun can be made safe by simply locking the handle of the cocking cam in that position or locking the breech bolt in that position. Alternately, the gun could be fired once with the chamber empty to relieve tension on the firing spring and close the chamber to prevent dirt from entering the chamber, although the mechanism is clearly sturdy enough to withstand a good bit of debris.

Through experimentation it has been found that the invention provides a method of firing an industrial 8 gauge kiln gun by which a single operator can point the gun into a kiln, and load and fire the gun repetitively into the kiln at a rate in excess of 1 shell per six seconds over a period in excess of 1 minute. The gun can generally be mounted in a fixed position and the rotation of the kiln used to move the target into the proper position for firing.

MODIFICATIONS AND INCORPORATIONS BY REFERENCE

Modifications

While the invention has been described above and below with reference to preferred embodiments and specific examples, it is apparent that many changes, modifications and variations in the materials, arrangements of parts and steps can be made without departing from the inventive concept disclosed herein. Accordingly, the spirit and broad scope of the appended claims is intended to embrace all such changes, modifications and variations that may occur to one of skill in the art upon a reading of the disclosure.

Incorporations By Reference

All patent applications, patents and other publications cited herein are incorporated by reference in their entirety as if they were set forth at length.

What is claimed is:

1. An autofiring mechanism for an industrial gun of the type having a rotary falling breech block lowered and raised by a handle, comprising:

a rotary cocking cam attached to the handle movable in a first direction to cock the gun and lower the breech block and in a second direction to raise the breech block; and a puller means connecting the rotary cocking cam to a trigger, the puller means being rigid in tension and flexible in compression.

2. The mechanism of claim 1 wherein the puller means is a chain.

3. The mechanism of claim 2 wherein the puller means further comprises an adjustment means for selectively adjusting the length of the puller means.

* * * * *